United States Patent [19]

Lopinski et al.

[11] 4,359,257

[45] Nov. 16, 1982

[54] MODULAR CONNECTOR FOR FLAT FLEXIBLE CABLE

[75] Inventors: Edward J. Lopinski, Dillsburg; Kenneth R. Parmer, Harrisburg, both of Pa.

[73] Assignee: AMP Incorporated, Harrisburg, Pa.

[21] Appl. No.: 200,743

[22] Filed: Oct. 27, 1980

Related U.S. Application Data

[63] Continuation of Ser. No. 55,565, Jul. 9, 1979, abandoned.

[51] Int. Cl.[3] ..... H01R 13/514

[52] U.S. Cl. ..... 339/99 R

[58] Field of Search ..... 339/97 R, 97 P, 98, 339/99

[56] References Cited

U.S. PATENT DOCUMENTS

| | | | |
|---|---|---|---|
| 3,444,506 | 5/1969 | Wedekind | 339/99 R |
| 3,816,818 | 6/1974 | Meier | 339/99 R |
| 3,820,055 | 6/1974 | Huffnagle | 339/17 F |
| 3,820,058 | 6/1974 | Friend | 339/99 R |
| 3,912,354 | 10/1975 | Campbell et al. | 339/99 R |
| 3,930,708 | 1/1976 | Wedekind | 339/99 R |
| 3,964,816 | 6/1976 | Narozny | 339/99 R |
| 4,068,912 | 1/1978 | Hudson | 339/99 R |
| 4,169,647 | 10/1979 | Knowles et al. | 339/99 R |
| 4,188,083 | 2/1980 | Knowles | 339/99 R |
| 4,190,952 | 3/1980 | Thomas et al. | 339/99 R |

FOREIGN PATENT DOCUMENTS

| | | | |
|---|---|---|---|
| 2653592 | 11/1976 | Fed. Rep. of Germany | 339/99 R |
| 2002599 | 2/1979 | United Kingdom | 339/99 R |

*Primary Examiner*—Mark Rosenbaum
*Assistant Examiner*—John S. Brown
*Attorney, Agent, or Firm*—Russell J. Egan

[57] ABSTRACT

An improved electrical connector is disclosed for terminating multi-conductor flat flexible cable. The connector includes a housing which is pre-loaded with a plurality of terminals, each having an insulation displacing portion extending from a mating face, and a cover which is adapted to be held on the housing in a spaced position, in an unterminated condition, and which fully seats against the housing upon termination. The cover further includes both cable stop means and conductor positioning means. The connector further can include a snap-in handle member which makes it easier to remove the assembled connector from an associated header.

8 Claims, 14 Drawing Figures

Fig. 2
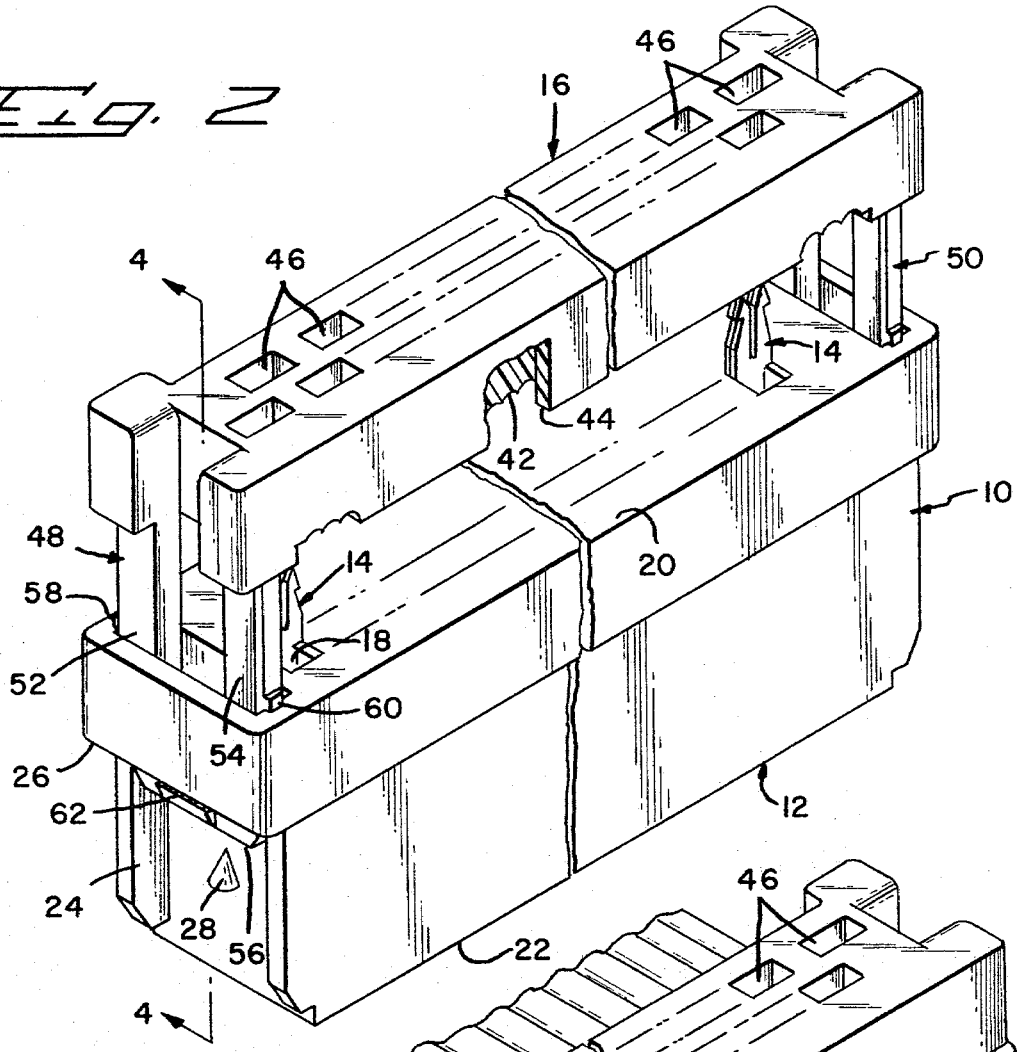
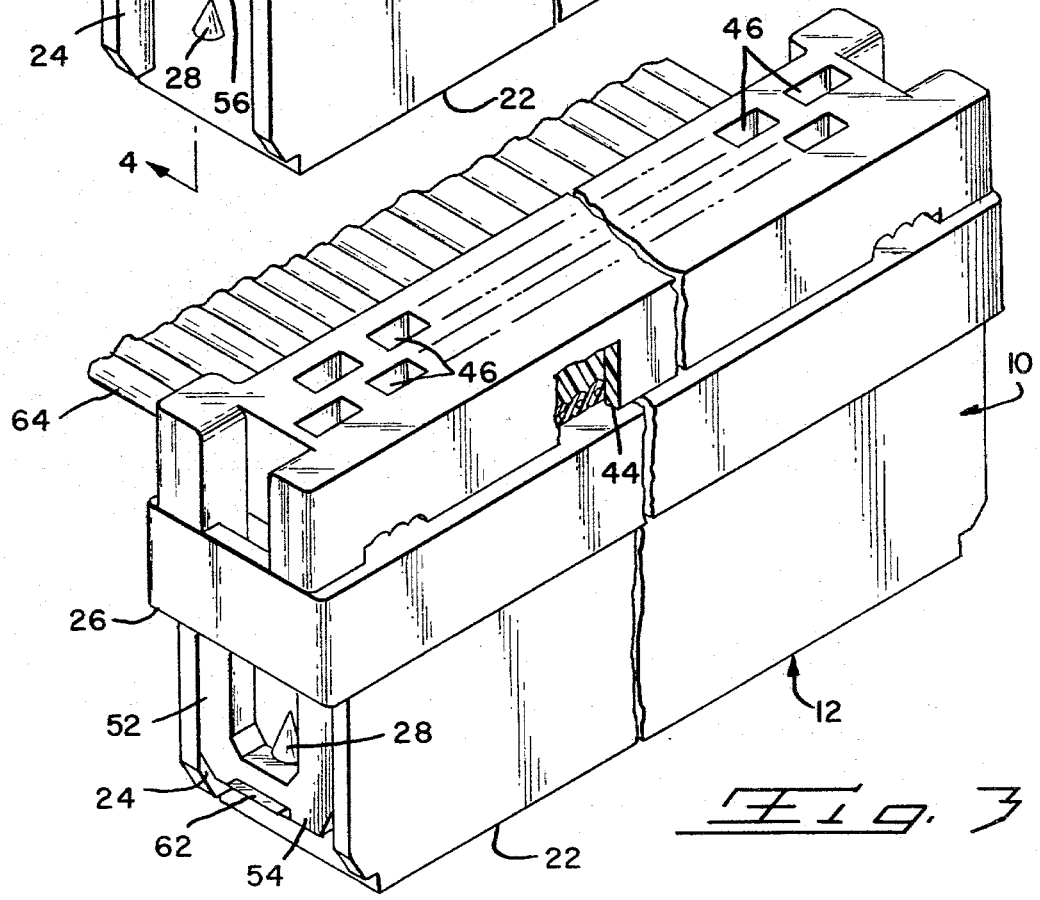
Fig. 3

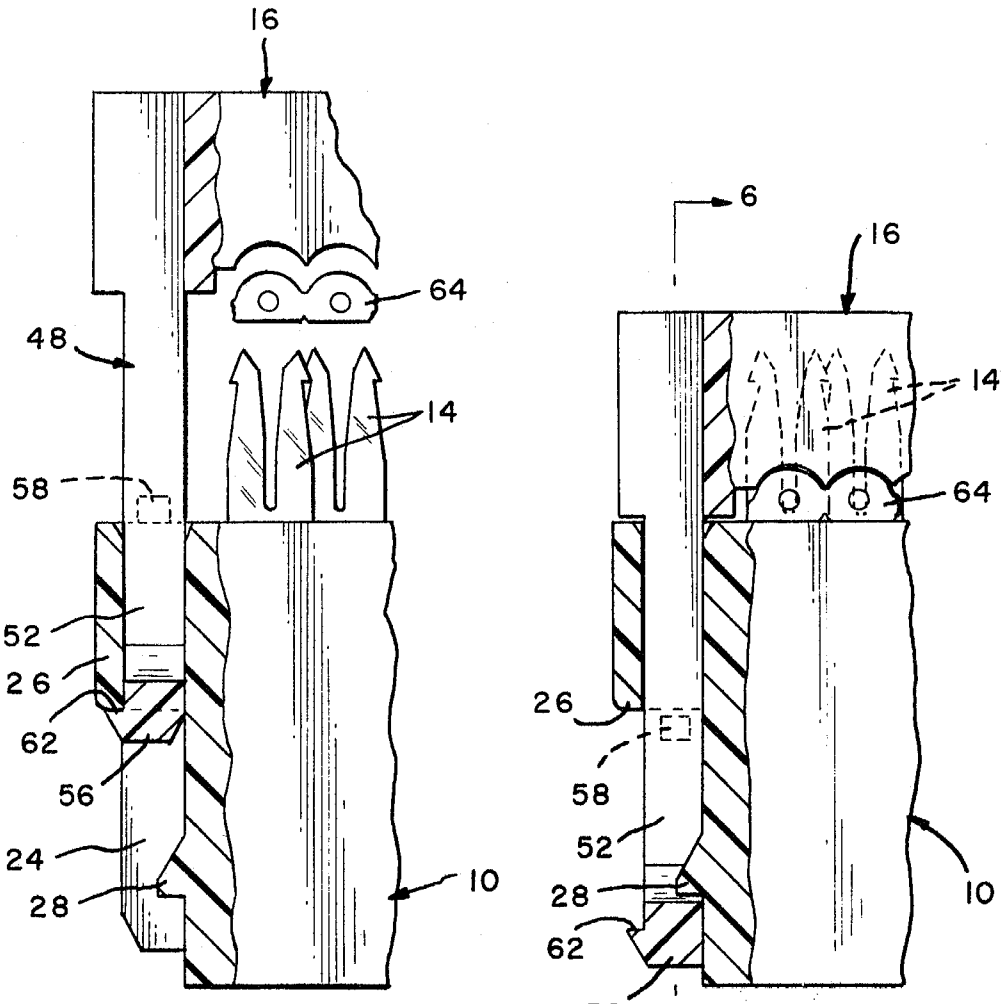
FIG. 4
FIG. 5
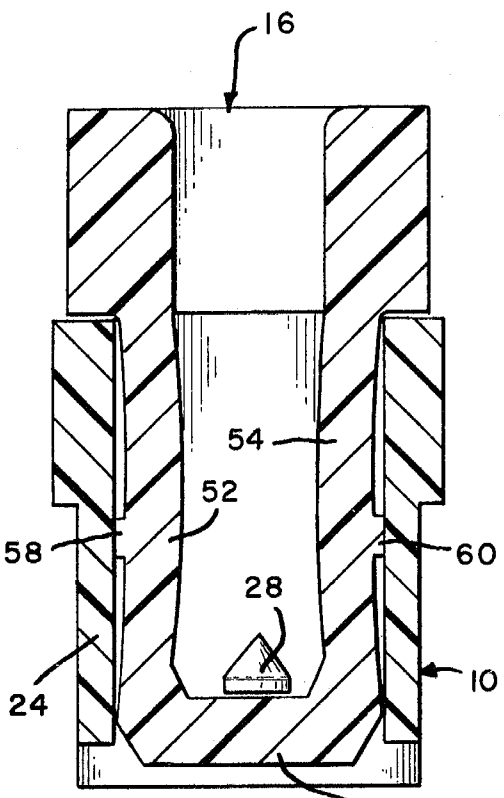
FIG. 6

MODULAR CONNECTOR FOR FLAT FLEXIBLE CABLE

This is a continuation of application Ser. No. 055,565, filed July, 9, 1979 and now abandoned.

BACKGROUND OF THE INVENTION

1. The Field of the Invention

The present invention relates to an improved electrical connector for flat flexible cable and in particular to one which can be sold in a complete assembly ready to be terminated on a cable with a single stroke and without any further assembly of the connector itself by the customer.

2. The Prior Art

Electrical connectors for terminating multi-conductor flat flexible cable are well known. For example, U.S. Pat. No. 3,820,055 shows an electrical connector which has a housing with a plurality of terminals mounted therein. The terminals have a mating portion mounted in the housing and an insulation displacing conductor engaging portion extending from one surface of the housing. The connector is disclosed as being terminated to a cable by first applying the cable to the mating face of the connector in such a fashion as to effect an insulation displacing engagement between the terminals and the respective conductors. A separate cover member is then applied to the assembly and the free ends of the insulation displacing portions of the terminals grippingly engage the cover to securely hold it against the housing with the cable sandwiched therebetween.

While the above described connector has been made commercially successful by the common assignee, it does have certain disadvantages. For example, it is not always the customers preferance to have the connector with individual components must be assembled at the time of termination. Multiple parts cause problems in requiring multiple stock to be kept and the requirement that proper amounts of stock be removed from the storage and be at the assembly point at the appropriate time. A further disadvantage of the noted connector, is the two step operation for assembly. Clearly it is economically more preferable to have termination carried out with as few operational steps as possible.

SUMMARY OF THE INVENTION

The present invention overcomes the difficulties described in connection with the known connector by providing a connector assembly which is preassembled into a single unit for sale and which can be terminated in a single step operation. The connector includes a housing having an elongated profile with a through passage at each end thereof, a mating face and an oppositely directed cable receiving face. The passage includes a centrally disposed latching lug and a bridging strap at one end of the passage. The housing includes a plurality of terminal passageways extending between the faces thereof. A terminal is positioned in each of the passageways with each terminal having an insulation displacing portion projecting from cable receiving face and a mating portion directed toward the mating face of the housing. A cover is formed by a like elongated member and has a profiled cable guiding surface and a cable abutment extending downwardly from one marginal edge of the surface. At each end of the cover there is a depending latching means with each latching means having at least one lug thereon. The lug is positioned on the latching means so as to hold the profiled cable guiding surface of the cover spaced from the cable receiving face of the housing. The cover is preassembled on the housing with the latching means extending into the passageways with the lugs positioned to hold the cover in position spaced above both the terminals and the mating face of the connector. The connector can further be provided with a handle for purposes of assisting extraction of the connector from a mating header. The extraction handle includes a gripping portion and two downwardly depending legs, each with an outwardly directed lug. The legs can be extended through the straps of the housing to engage therewith and provide an adequate gripping for the lugs on the legs so that the connector can be withdrawn from a header with relative ease.

It is therefore an object of the present invention to produce an improved connector which can be sold as a single assembled unit having a housing, a cover removably attached thereto, and a plurality of terminals carried therein.

It is another object of the present invention to produce an improved electrical connector which can be terminated to a multi-conductor flat flexible cable in a one step operation.

It is yet another object of the present invention to produce an improved electrical connector having handle means available for ease in removing the connector from an associated header.

It is a further object of the present invention to produce an electrical connector which can be readily and economically manufactured.

The means for accomplishing the foregoing objects and other advantages will become apparent to those skilled in the art from the following detailed description taken with reference to the accompanying drawings.

BRIEF DESCRIPTION OF THE DRAWINGS

FIG. 2 is a perspective view of the subject connector in an assembled but unterminated condition;

FIG. 3 is a perspective view of the subject connector in a fully assembled and terminated condition;

FIG. 4 is a detail, partially in section, showing the engagement of the latching means in the condition of FIG. 2;

FIG. 5 is a detail similar to FIG. 4 showing the connector in a fully assembled condition of FIG. 3;

FIG. 6 is a detail, partially in section, taken along lines 6—6 of FIG. 5;

DETAILED DESCRIPTION OF THE PREFERRED EMBODIMENTS

Figure 1:
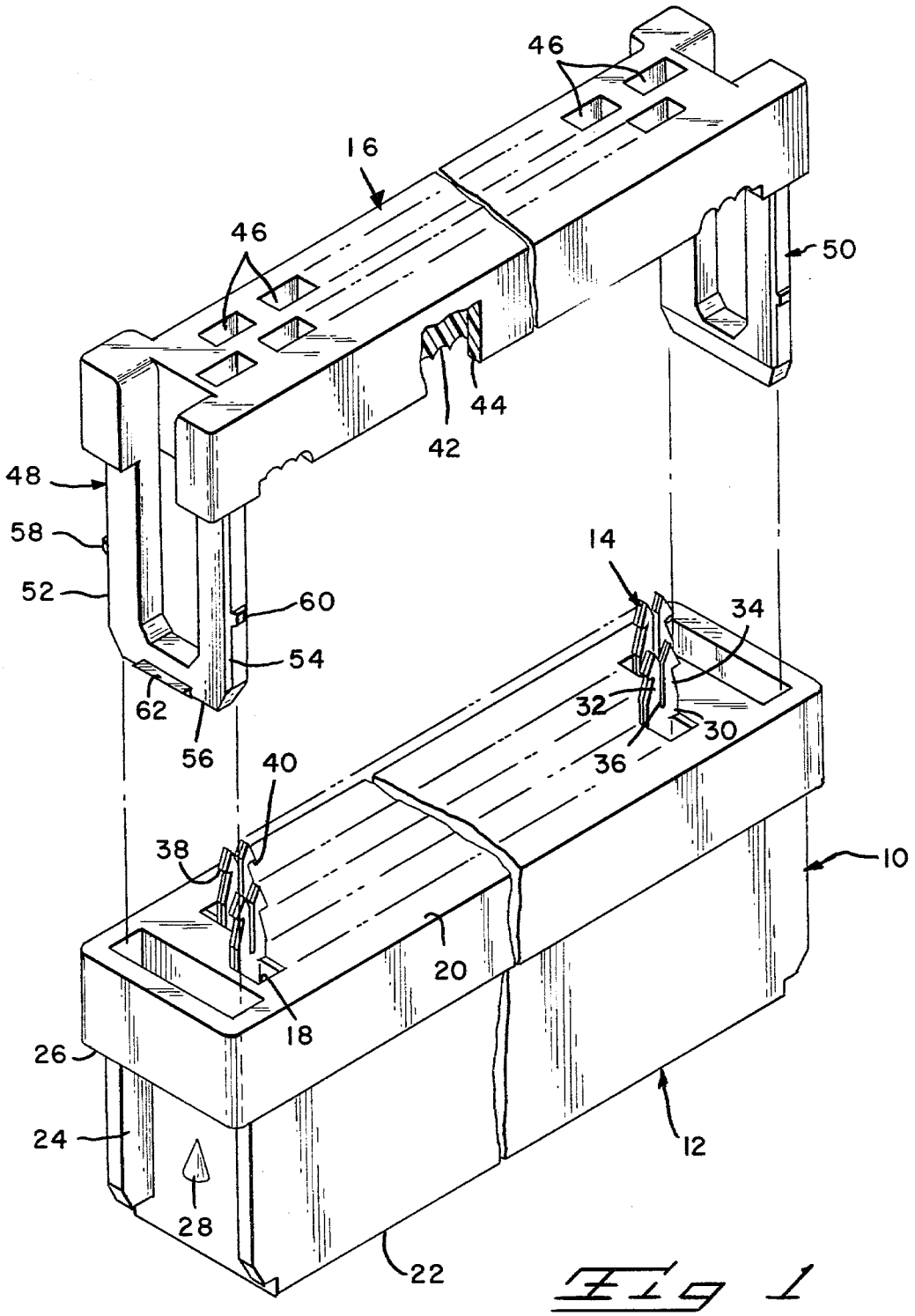
FIG. 1 is an exploded perspective view of a first embodiment of the subject invention.

The embodiment of the subject connector 10, shown in FIGS. 1 to 6, includes a housing 12, a plurality of terminals 14, and a cover 16. The housing 12 is an elongated member of insulative material having a plurality of terminal passages 18 extending therethrough from a cable engaging face 20 to a mating face 22. At each end of the housing there is a passage formed by a channel 24 with a strap 26 overlying the end of the channel adjacent the cable engaging face 20. Centered in the open part of the channel is a latching stud 28.

The terminals 14 are preferably of the type disclosed in U.S. Pat. No. 3,820,055, the disclosure of which is incorporated herein by reference. This disclosure is referred to primarily for the structure of the terminals, since the method of terminating with the subject connector and the connector of the patent are different. Each terminal includes an insulation displacing conductor engaging end 30 that includes a pair of arms 32, 34 defining a slot 36 therebetween with each arm having an outwardly directed shoulder 38, 40 adjacent the free ends thereof.

The cover 16 has an elongated profile similar to that of the housing 12. It includes a cable engaging face 42 which has a fluted profile to assist in alignment of the conductors of a cable. It also includes a downwardly depending abutment 44 along one elongated marginal edge which serves as a cable stop. The cover also includes a plurality of terminal passages 46 each aligned with a respective terminal passage 18 in the housing 12. The passages 46 are of such dimension as to provide an interference fit for the arms 32, 34 of the terminals 14 so that the shoulders 38, 40 will make a biting engagement with the sidewalls thereof. The cover further includes a pair of latching members 48, 50 at the opposite ends thereof. Each latching member has a U-shape defined by a pair of downwardly depending leg members 52, 54 and a connecting bottom cross bar 56. Each of the legs has an outwardly directed lug 58, 60 and the cross bar likewise has lug 62 directed outwardly of the end of the cover.

The connector is preferably assembled into the condition shown in FIG. 2 by the manufacturer. The housing is first pre-loaded with a plurality of terminals 14 and then the cover is applied with the latching members 48, 50 each being received in a respective passage 24 with the lugs 62 engaging the bottom of the straps 26 and the lugs 58, 60 resting against the top of the strap 26. In this condition the assembly forms a single unit which is convenient for handling and shipping. The unit also includes all parts necessary to effect termination.

Termination is accomplished by simply inserting a multi-conductor flat flexible cable 64 into the connector 10 against the fluted engagement face 42 of the cover 16. There is sufficient space between mating face 42 of the cover and the free ends of the terminals 14, as shown in FIG. 4, to allow free entry of the end of the cable. The assembly of the connector and the cable is then placed in a press or like tool and the cover is driven into a fully engaged position against the housing, as shown in FIGS. 3 and 5. During this movement the arms 32, 34 of the terminals 14 will be driven through the insulation of the cable with the conductors being received in the respective slots 36. It will also be noted from FIGS. 3, 5, and 6 that the completed movement brings the cross bar 56 of the cover to a position beneath the lug 28 so that the cover is latched into position with respect to the housing. Further, the terminating motion drives the free ends of the arms 32, 34 of the terminals 14 into the respective apertures 46 in the cover 16 with the shoulders 38, 40 biting into the sidewalls thereof.

Figure 7:
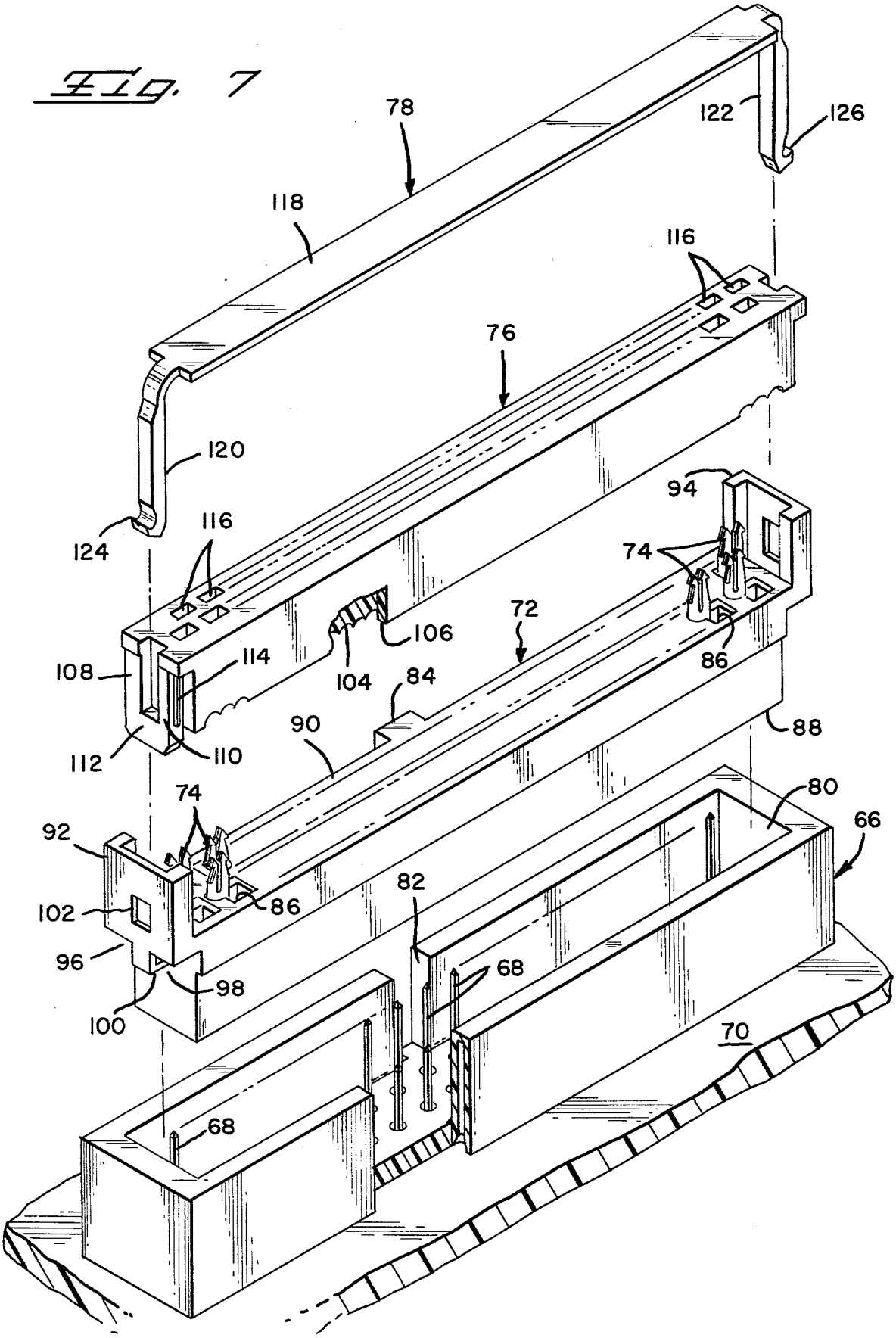
FIG. 7 is an exploded perspective view of an alternate embodiment of the present invention.
Figure 8:
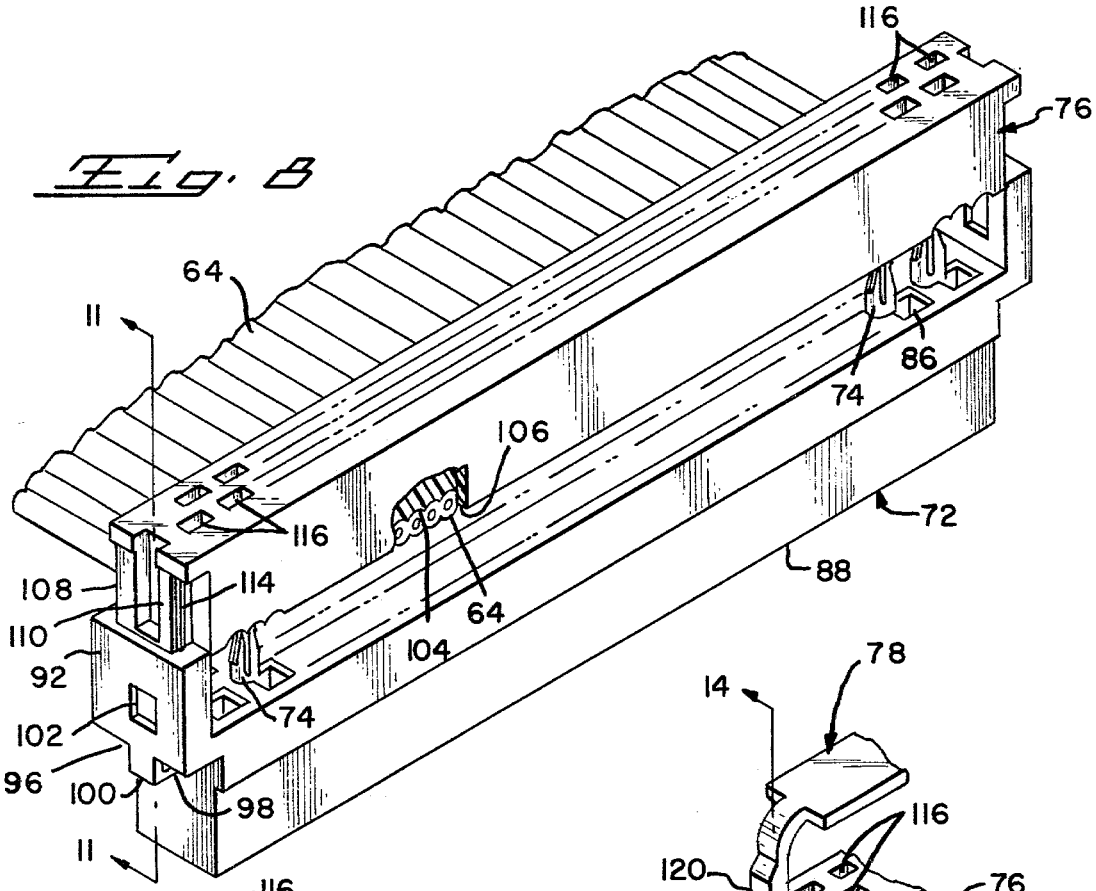
FIG. 8 is a perspective view of the alternate embodiment of FIG. 7 in the assembled but unterminated condition.
Figure 9:
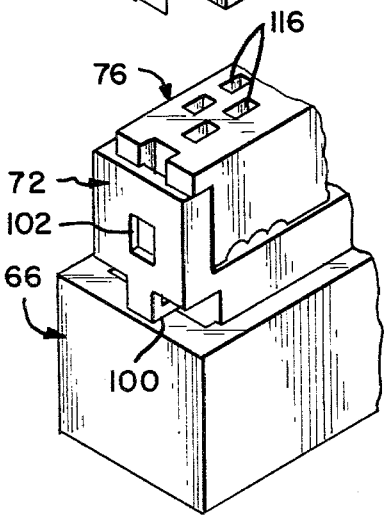
FIG. 9 is a detail view of the end of the alternate embodiment of the subject connector.
Figure 10:
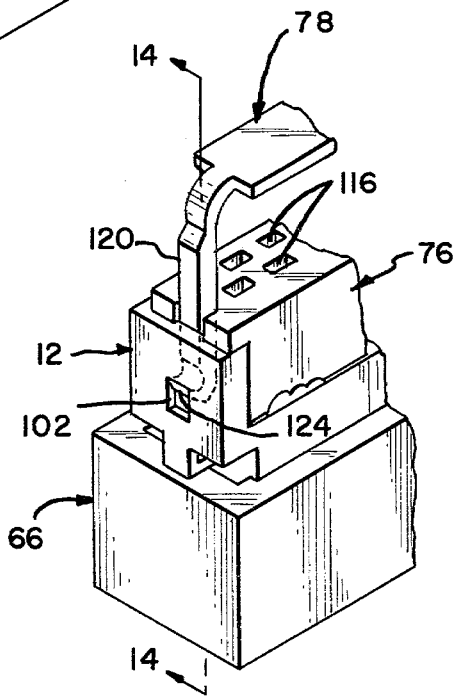
FIG. 10 is a detail view, similar to FIG. 9, showing the attachment of the handle to the alternate embodiment of the subject connector.
Figures 11, 12, 13, 14:
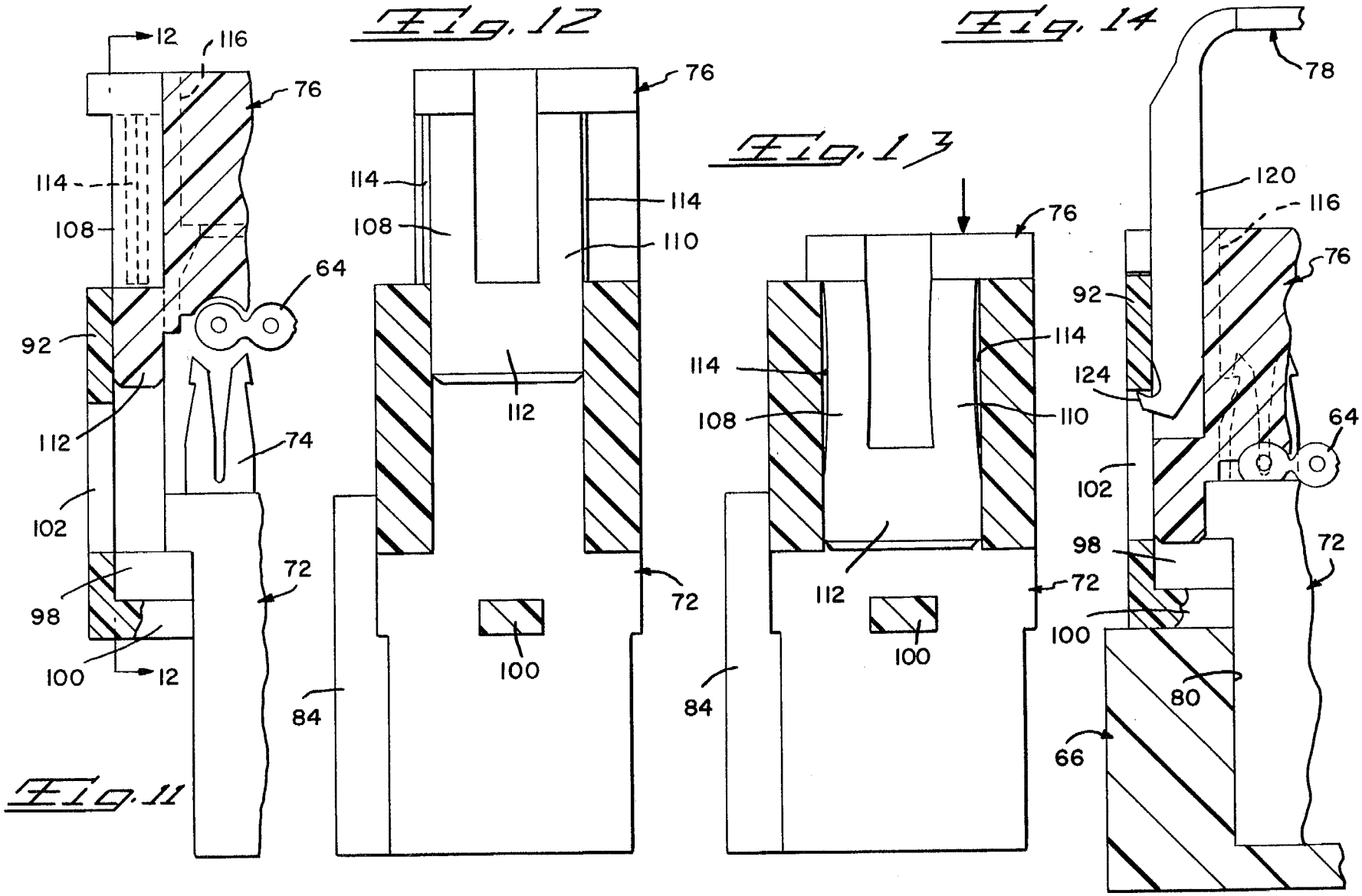
FIG. 11 is a detail view, partially in longitudinal section, showing the intermating of the cover and housing.
FIG. 12 is a detail view, partially in transverse section, showing the intermating of the cover and housing.
FIG. 13 is a detail view, similar to FIG. 12, showing the cover and housing after termination.
FIG. 14 is a detail view, partially in longitudinal section, showing a handle attached to the subject connector.

The alternate embodiment of the subject invention is shown in FIGS. 7 to 14 and includes a header 66 enclosing a plurality of pin terminals 68 mounted secured to a printed circuit board 70, a housing 72 having a plurality of terminals 74 mounted therein, a cover 76, and a handle 78.

The header 66 is of conventional design and is an elongated member of insulative material having an elongated central cavity 80 and a polarizing slot 82 in one sidewall. The header is mounted on a printed circuit board 70 in conventional fashion, for example, loading the pins 68 into the circuit board 70 and soldering them to the circuitry (not shown) and then positioning the header about the pins with latching means (not shown) securing the header 66 on the printed circuit board 70.

The housing 72 is an elongated member having an outer profile adapted to be received in the cavity 80 of the header 66. For this purpose the housing 72 includes a keying projection 84 which is received in the polarizing slot 82 of the header. The housing has a plurality of terminal passages 86 extending between a mating face 88 and a cable receiving surface 90. At each end of the housing there is an integral latching member 92, 94 each of which has an inwardly directed channel shaped section with one end of the section integral with the housing and defining a pair of passages 96, 98 on opposite sides of a centrally positioned leg 100. A centrally disposed aperture 102 is in each member 92, 94 spaced above the leg 100.

Each of the terminals 74 is of the type previously mentioned having a mating socket portion (not shown) and an insulation displacing conductor engaging portion extending above the cable receiving surface 90. Each conductor engaging portion has a pair of legs with a pair of outwardly directed tines on the free ends thereof and defining a slot therebetween, in the same manner as previously described.

The cover 76 is an elongated member having a cable engaging face 104 which is preferably fluted to assist in aligning conductors of the cable. The cover also has a downwardly depending abutment 106 along one marginal edge thereof. At each end of the cover there is a latching member formed by a pair of depending legs 108, 110 and a cross bar 112 connecting the bottom ends of the legs. Each leg has an outwardly directed elongated projection 114 which extends along a portion of each leg from the upper end. The cover also includes a plurality of apertures 116, each of which is aligned with a respective terminal passage 86 of the housing 72.

The handle 78 includes a central gripping portion 118 and a downwardly depending leg 120, 122 on each end thereof, each leg having an outwardly directed lug 124, 126 on the free ends thereof.

The subject connector is assembled in the same manner as the previously discussed embodiment with the housing 72 being pre-loaded with terminals 74. The cover 76 is applied to the housing 72 with the lower portion of the latching members, legs 108, 110, forming interference fits in the channel shaped members 92, 94. This interference fit holds the cable engaging face 104 of the cover spaced above the cable receiving face of the housing forming a unit or fixed assembly therewith.

The connector is applied to a cable in the same manner as previously described by inserting the cable 128 between the cover 76 and the terminals 74 and then applying pressure to drive the cover 76 into a fully seated condition against the housing 72. The elongated projections 114 on legs 108, 110 of the latching members are driven into the walls of the channel-shaped latch members 92, 94 to secure the cover in place. At the same time this seating is occurring, the terminals 74 penetrate the insulation of the cable 64 and make a good electrical and mechanical connection with the individual conductors thereof. The shoulders on the tines of the terminals will bite into the sidewalls of apertures 116 in the cover to hold the cover against the housing along the entire length thereof with no bowing in the middle of the cover.

The handle 78 can be applied to the assembled connector with the lugs 124, 126 extending through the apertures 102 in the latch members 92, 94. The terminated connector can then be applied to the header 66 and can easily be removed by pulling on the handle 78. This avoids any temptation to remove the connector, which has a rather low profile, from the header by pulling on the cable and possibly damaging the interconnect between the conductors thereof and the terminals of the connector.

The present invention may be subject to many modifications and changes without departing from the spirit of essential characteristics thereof. The present embodiments are therefor intended as being illustrative and not restrictive of the scope of the invention.

What is claimed is:

1. An improved electrical connector for terminating multi-conductor flat flexible cable, said connector comprising: an elongated housing member of insulating material having oppositely directed mating and cable receiving faces, a plurality of terminal passages extending between said faces in a patterned array, an outwardly directed latching channel at each end of said housing with a strap spanning and partially enclosing each said channel at the end adjacent said cable receiving face, and a latching lug in each said latching channel spaced from said strap;

a like plurality of terminals each mounted in a respective passage in said housing member with a mating portion directed toward said mating face and an insulation piercing conductor engaging portion extending from said cable receiving face; and an elongated cover of insulating material having a cable engaging surface, a like plurality of apertures in said surface each aligned with a respective passage in said housing member, and a latching member depending from each end of said cover normal to said cable engaging surface and received in said latching channel each said latching member defining a central opening, means on each said latching member which engage said latching channel in a first position to hold the cable engaging surface of said cover spaced above said cable receiving face of said housing and which must be overcome to move said cover to a second position to receive said latching lugs in said openings of respective latching members to grip a cable between said cover and said housing.

2. An improved electrical connector according to claim 1 wherein:

each said latching member comprises at least one leg having first and second outwardly directed spaced lugs thereon adapted to engage opposite sides of said strap to hold said cover in said first position.

3. An improved electrical connector according to claim 1 wherein each said latching member comprises:

a pair of spaced legs and a crossbar connecting the free ends of said legs, said first lugs being outwardly directed from said legs intermediate the length thereof and said second lug being outwardly directed from said crossbar whereby said first and second lugs are spaced to engage opposite sides of said strap and said legs and crossbar define an aperture to receive said latching lug.

4. An improved electrical connector according to claim 3 further comprising:

an elongated handle having a central gripping portion and leg portions depending from each end, each said leg portion adapted to engage a respective strap whereby unmating of the connector is facilitated.

5. An improved electrical connector according to claim 1 wherein said cover further comprises:

an abutment depending from one marginal edge transversely of said cable engaging surface and serving as a cable end stop.

6. An improved electrical connector according to claim 1 wherein said cover further comprises:

a fluted profile on said cable engaging surface adapted to position conductors of said multi-conductor cable.

7. An improved electrical connector for terminating multi-conductor flat flexible cable, said connector comprising:

an elongated housing member of insulating material having oppositely directed mating and cable receiving faces, a plurality of terminal passages extending between said faces, an outwardly directed latching channel at each end of said housing, a transverse strap spanning said channel at the end adjacent said cable receiving face, and a latching lug in said channel-spaced from said strap;

a like plurality of terminals each mounted in a respective passage with a mating portion directed toward said mating face and a conductor engaging portion extending from said cable receiving face; and an elongated cover of insulating material having a cable engaging surface, a like plurality of apertures in said surface each aligned with a respective passage in said housing member, and a U-shaped latching member depending from each end of said cover and defined by a pair of spaced leg portions joined at one end by a crossbar, first lugs extending outwardly of said leg portions intermediate the ends thereof and at least one second lug extending from said crossbar, said first and second lugs being spaced apart a distance substantially the same as the width of said strap;

whereby said first and said second lugs engage opposite sides of said strap to hold said cover in a first position with said cable engaging surface spaced from said cable receiving face and said first lugs must be overcome to be pushed through said strap so that said latching members engage said latching lug to hold said cover in a second position pressing said cable against said housing.

8. An improved electrical connector according to claim 7 further comprising:

an elongated handle having a central gripping portion and a depending leg portion at each end thereof, each said leg portion adapted to pass between said leg portions of said cover latching member and engage said strap;

whereby said connector can be readily unmated.

* * * * *